US011712727B2

(12) United States Patent
Se et al.

(10) Patent No.: US 11,712,727 B2
(45) Date of Patent: Aug. 1, 2023

(54) BEND PIPE AND METHOD FOR MANUFACTURING SAME

(71) Applicant: NORITZ CORPORATION, Hyogo (JP)

(72) Inventors: Naoki Se, Hyogo (JP); Shoji Okuda, Hyogo (JP); Hideyuki Fujisawa, Hyogo (JP)

(73) Assignee: NORITZ CORPORATION, Hyogo (JP)

( * ) Notice: Subject to any disclaimer, the term of this patent is extended or adjusted under 35 U.S.C. 154(b) by 225 days.

(21) Appl. No.: 17/055,122

(22) PCT Filed: Jun. 17, 2019

(86) PCT No.: PCT/JP2019/023815

§ 371 (c)(1),
(2) Date: Nov. 12, 2020

(87) PCT Pub. No.: WO2020/021906

PCT Pub. Date: Jan. 30, 2020

(65) Prior Publication Data

US 2021/0121929 A1 Apr. 29, 2021

(30) Foreign Application Priority Data

Jul. 26, 2018 (JP) ..... 2018-140472

(51) Int. Cl.
*B21D 7/02* (2006.01)
*B21C 51/00* (2006.01)
(Continued)

(52) U.S. Cl.
CPC ..... *B21C 51/005* (2013.01); *B21C 37/283* (2013.01); *B21D 7/025* (2013.01); *B21D 41/026* (2013.01)

(58) Field of Classification Search
CPC ..... B21C 51/00; B21C 51/005; B21C 37/283; B21C 37/30; B21D 7/024; B21D 7/025;
(Continued)

(56) References Cited

U.S. PATENT DOCUMENTS 1,478,480 A * 12/1923 Lowe ..... B21D 9/073 72/369
1,604,489 A * 10/1926 Seiffert ..... B21D 9/14 72/369
(Continued)

FOREIGN PATENT DOCUMENTS

DE 1257002 B * 12/1967 ..... B21C 37/283
GB 408825 A * 4/1934 ..... B21D 9/14
(Continued)

OTHER PUBLICATIONS

Machine translation of JP2004-216388, Retrieved from Espacenet Aug. 19, 2022, 5 Pages. (Year: 2004).*
(Continued)

*Primary Examiner* — Edward T Tolan
(74) *Attorney, Agent, or Firm* — JCIPRNET

(57) ABSTRACT

A metal bend pipe having a bend portion bent in a semi-circular arc shape is provided, in which an identification part that enables one of the two end portions of the bend portion to be identified as the bending-start side or the bending-end side is provided, and the identification part is integrally formed as a protruding and/or recessed three-dimensional region. Thus, it is possible to easily and reliably identify which of the two end portions of the bend portion is the bending-start side or the bending-end side.

2 Claims, 6 Drawing Sheets

(51) Int. Cl.
*B21D 7/025* (2006.01)
*B21C 37/28* (2006.01)
*B21D 41/02* (2006.01)

(58) Field of Classification Search
CPC ..... B21D 7/028; B21D 7/02; B21D 35/002; B21D 9/14
USPC ..... 72/370.19, 370.21
See application file for complete search history.

(56) References Cited

U.S. PATENT DOCUMENTS

| | | | | | |
|---|---|---|---|---|---|
| 3,512,392 | A * | 5/1970 | Paulv | B21D 7/06 | 72/389.8 |
| 5,142,895 | A * | 9/1992 | Schuchert | F28F 1/006 | 72/149 |
| 5,337,590 | A * | 8/1994 | Schuchert | B21D 7/02 | 72/157 |
| 6,349,521 | B1 * | 2/2002 | McKeon | E04C 3/06 | 52/843 |
| 7,222,512 | B2 * | 5/2007 | Dossmann | B21D 9/14 | 72/62 |
| 2003/0005741 | A1 * | 1/2003 | Sayler | B21D 7/00 | 72/369 |
| 2016/0354822 | A1 * | 12/2016 | Nozu | B21D 7/024 | |

FOREIGN PATENT DOCUMENTS

| | | | | |
|---|---|---|---|---|
| JP | H04043414 | | | 4/1992 |
| JP | H04258317 | | | 9/1992 |
| JP | 2851561 | | | 1/1999 |
| JP | H-11183171 | A | * | 7/1999 |
| JP | 2004216388 | A | * | 8/2004 |
| JP | 3704781 | | | 10/2005 |
| JP | 2006336694 | A | * | 12/2006 |
| JP | 4506766 | | | 7/2010 |
| JP | 2012135797 | | | 7/2012 |
| JP | 2013000794 | A | * | 1/2013 |
| JP | 5728937 | | | 6/2015 |
| JP | 5771821 | | | 9/2015 |
| JP | 5885322 | | | 3/2016 |
| JP | 2016131977 | | | 7/2016 |
| JP | 5052890 | | | 12/2016 |

OTHER PUBLICATIONS

Machine translation of JP2006-336694, Retrieved from Espacenet Aug. 17, 2022, 6 Pages. (Year: 2006).*
Machine translation of JP2013-000794, Retrieved from Espacenet Aug. 19, 2022, 6 Pages. (Year: 2013).*
Machine translation of JPH11-183171, Retrieved from J-Plat19 Aug. 2022, 22 Pages. (Year: 1999).*
JP 10-196361 A, Tamaki et al., Jul. 1998.*
Translation DE 1257002B, Fantini Dec. 1967.*
"International Search Report (Form PCT/ISA/210)" of PCT/JP2019/023815, dated Jul. 16, 2019, with English translation thereof, pp. 1-4.

* cited by examiner

BEND PIPE AND METHOD FOR MANUFACTURING SAME

CROSS-REFERENCE TO RELATED APPLICATION

This application is a 371 application of the international PCT application serial no. PCT/JP2019/023815, filed on Jun. 17, 2019, which claims the priority benefits of Japan application no. 2018-140472, filed on Jul. 26, 2018. The entirety of each of the above-mentioned patent applications is hereby incorporated by reference herein and made a part of this specification.

TECHNICAL FIELD

The present invention relates to a bend pipe that is a component of a heat transfer pipe in a heat exchanger or used as a piping member or the like, and a method for manufacturing the same.

BACKGROUND ART

When a heat transfer pipe of a heat exchanger is fabricated, means such as connecting a plurality of linear metal pipe bodies by using bend pipes having semicircular arc bend portions are often adopted. Here, the bend pipe is manufactured by bending a straight tubular metal pipe that is a starting material using a pipe bender (for example, Patent Literatures 1 and 2, and the like), and then, cutting the metal pipe at an appropriate place. Preferably, terminal treatment such as pipe expanding processing or the like is performed on both end portions of the bend pipe, and thus the dimensional accuracy thereof is increased.

However, in the related art, as described below, there is still room for improvement.

That is, in a process of bending a straight tubular metal pipe using a pipe bender, the metal pipe is generally bent along a circumferential surface of a roll block of the pipe bender while pulling the metal pipe. In such bending, the bend portion of the metal pipe curved in a semi-circular arc shape receives a larger amount of tensile load at a bending-start side portion than a bending-end side portion. For this reason, when a bend pipe has been formed by cutting a metal pipe, the bending of which has been completed, at the vicinity of the two ends of the bend portion, the diameters or thicknesses of the two end portions of the bend pipe are often different. An end portion on a bending-start side has a smaller diameter and a smaller thickness than an end portion on a bending-end side.

Meanwhile, when a heat transfer pipe is fabricated by connecting bend pipes to other linear pipe bodies using brazing means or the like, dimensional control of both end portions of the bend pipe needs to be appropriately achieved. For this reason, terminal treatment is performed on both end portions of the bend pipe. However, when the diameters or thicknesses of both end portions of the bend pipe are different, for example, even when pipe expanding punches having the same size are press-fitted into both end portions of the bend pipe, the final finishing dimensions may not be the same. To equalize the finished dimensions, it is required to detect in advance which side of both end portions of the band pipe is the bending-start side (a small diameter side) or the bending-end side (a large diameter side), and use the pipe expanding punch corresponding thereto.

On the other hand, in the related art, no measures have been taken into consideration to determine which side of both end portion of the bend pipe is the bending-start side or the bending-end side. In addition, a difference in diameter or thickness between the two ends is almost indistinguishable just by visually observing both end portions of the bend pipe. Accordingly, it is difficult to perform appropriate terminal treatment according to a difference in diameter or thickness between the two end portions of a bend pipe.

CITATION LIST

Patent Literature

[Patent Literature 1] Japanese Patent Laid-Open No. 2016-131977

[Patent Literature 2] Japanese Patent Laid-Open No. 2012-135797

SUMMARY OF INVENTION

Technical Problem

An objective of the present invention is directed to providing a bend pipe capable of appropriately solving the above-mentioned problems, and a method for manufacturing the same.

Solution to Problem

In order to solve the problems, in the present invention, the following technical means are provided.

A bend pipe provided according to a first aspect of the present invention is a bend pipe made of metal and having a bend portion curved in a semicircular arc shape, including: an identification part, configured to identify which side of both end portions of the bend portion is a bending-start side or a bending-end side, and the identification part being integrally formed as a protruding and/or recessed three-dimensional region.

Preferably, the identification part is provided at a position offset from a centerline of the bend portion to either side of the two end portions.

Preferably, in the bend pipe according to the present invention, as the identification part, an identification part configured as a recessed part formed in an outer surface of the bend pipe is provided.

Preferably, in the bend pipe according to the present invention, as the identification part, an identification part configured as a wrinkle part formed on an inner circumferential surface of the bend portion is provided.

A method for manufacturing a bend pipe provided according to a second aspect of the present invention is a method for manufacturing a bend pipe, including: a bending process of pulling a metal pipe with a straight tubular shape formed of a starting material while bending the metal pipe along a circumferential surface of a roll block of a pipe bender, so as to form a bend portion with a semicircular arc shape in the metal pipe; and a cutting process of cutting the metal pipe after the bending process. At any time from a beginning of the bending process to an end of the cutting process, an identification part providing process of integrally forming an identification part configured to identify which side of both end portions of the bend portion is a bending-start side or a bending-end side in the metal pipe as a protruding and/or recessed three-dimensional region is further provided.

Preferably, in the cutting process, while the bend portion is clamped using a pair of clamp members, a protruding part for forming the identification part is previously provided on at least one of the pair of clamp members, and as the identification part providing process, when the bend portion is clamped, a process of forming a recessed part as the identification part in an outer surface of the bend portion using the protruding part is provided.

Preferably, in the method for manufacturing the bend pipe according to the present invention, a process of fixing the bend portion using the pair of clamp members is provided, and each of the pair of clamp members has a recessed part with a semicircular arc shape into which the bend portion is fitted and set, the recessed part has a laterally asymmetrical shape, a first region of one side in a lateral width direction has a shape and a size corresponding to a bending-start side of the bend portion, and a second region opposite to the first region has a shape and a size corresponding to a bending-end side of the bend portion, and when an orientation of the bend portion in a case in which the bend portion is fitted into the recessed part is incorrect, the bend portion is not fitted into the recessed part in a coincided state.

Preferably, a wrinkle forming part with a recessed and/or protruding shape is formed on a circumferential surface of the roll block, and in the method for manufacturing the bend pipe according to the present invention, as the identification part providing process, a process of forming a wrinkle part as the identification part on an inner circumferential surface of the bend portion using the wrinkle forming part when the bend portion is formed on the metal pipe, in the bending process, is provided.

Other features and advantages of the present invention will become clearer from the description of the embodiment of the present invention given below with reference to the accompanying drawings.

DESCRIPTION OF EMBODIMENTS

Hereinafter, a preferred embodiment of the present invention will be described in detail with reference to the accompanying drawings.

Figure 1A:
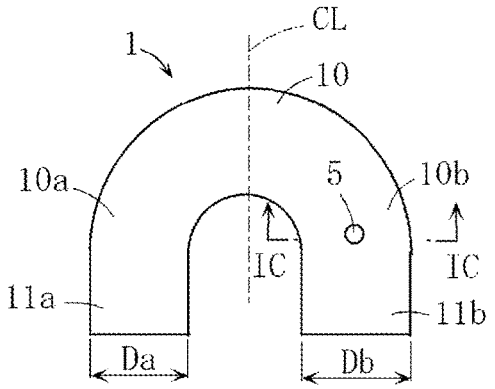
FIG. 1A is a front view showing an example of a bend pipe according to the present invention.
Figure 1B:
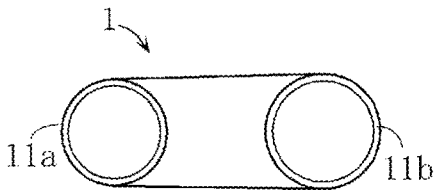
FIG. 1B is a bottom view of FIG. 1A.
Figure 1C:
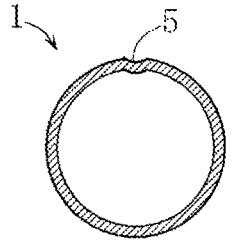
FIG. 1C is a cross-sectional view taken along line IC-IC of FIG. 1A.

A bend pipe 1 shown in FIG. 1A to FIG. 1C is made of, for example, stainless steel, and includes: a bend portion 10 curved in a semicircular arc shape, a pair of linear pipe parts 11*a* and 11*b* having a short pipe shape, which are integrally connected to both of end portions 10*a* and 10*b* of the bend portion 10, and an identification part 5.

The identification part 5 is, for example, a recessed part with a circular shape when seen in a front view, and provided to be offset from a centerline CL of the bend portion 10 in a widthwise direction to the vicinity of the end portion 10*b* of the bend portion 10. The bend portion 10 is a portion formed through a bending process, which will be described below, and the end portion 10*a* is a bending-start side, and the end portion 10*b* is a bending-end side. A diameter Da of the end portion 10*a* on the bending-start side and the linear pipe part 11*a* connected thereto is slightly smaller than a diameter Db of the end portion 10*b* on the bending-end side and the linear pipe part 11*b* connected thereto. The end portion 10*a* and the linear pipe part 11*a* are slightly thinner than the end portion 10*b* and the linear pipe part 11*b*. The identification part 5 is disposed to be offset from the centerline CL in the widthwise direction to the vicinity of the end portion 10*b* on the bending-end side.

Figure 2A:
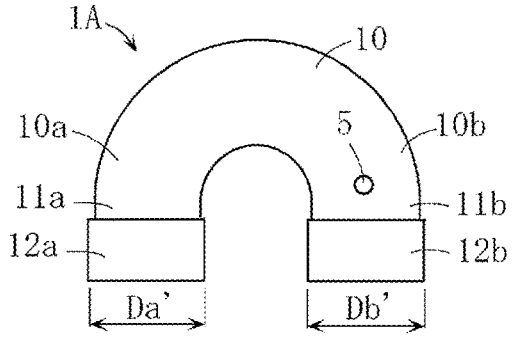
FIG. 2A is a front view showing that terminal treatment is performed on the bend pipe shown in FIG. 1A.
Figure 2B:
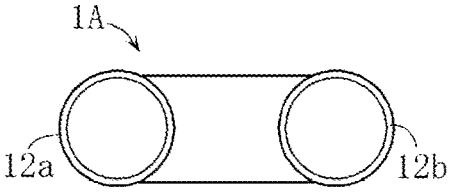
FIG. 2B is a bottom view of FIG. 2A.

A bend pipe 1A shown in FIG. 2A and FIG. 2B has a configuration in which terminal treatment parts 12*a* and 12*b* as pipe expanding parts are provided on the linear pipe parts 11*a* and 11*b* of the bend pipe 1.

The above-mentioned bend pipes 1 and 1A are manufactured through a series of processes, which will be described below.

Figure 3A:
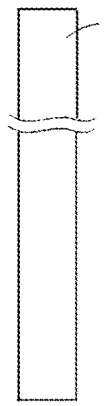
FIG. 3A to FIG. 3E are views for schematically describing a manufacturing process of the bend pipe shown in FIG. 1A and FIG. 2A.
Figure 3B:
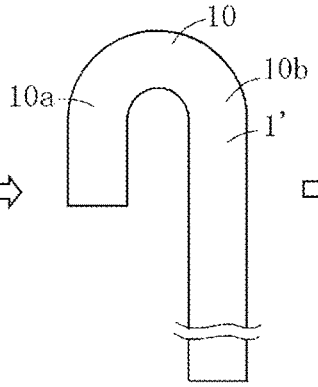
Figure 3C:
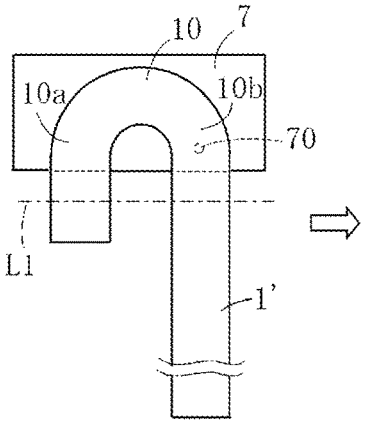
Figure 3D:
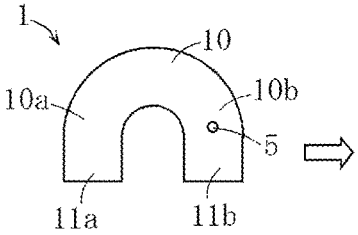
Figure 3E:
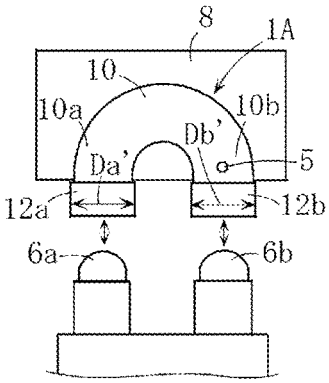

Describing the series of processes in brief, first, as a starting material of the bend pipe 1, a straight tubular metal pipe 1' (a stainless steel pipe) as shown in FIG. 3A is used. By performing a bending process on the metal pipe 1', as shown in FIG. 3B, the metal pipe 1' partially having the bend portion 10 is fabricated. Then, as shown in FIG. 3C, the metal pipe 1' is cut at a position of a virtual line L1 with an appropriate dimension, and the bend pipe 1 as shown in FIG. 3D is obtained. After that, as shown in FIG. 3E, both ends of the bend pipe 1 are expanded using pipe expanding punches 6*a* and 6*b* to form the terminal treatment parts 12*a* and 12*b*. However, in a cutting process shown in FIG. 3C, as described below, a protruding part 70 is formed on a clamp member 7 to clamp the metal pipe 1', and the identification part 5 is provided using the protruding part 70.

Figure 4A:
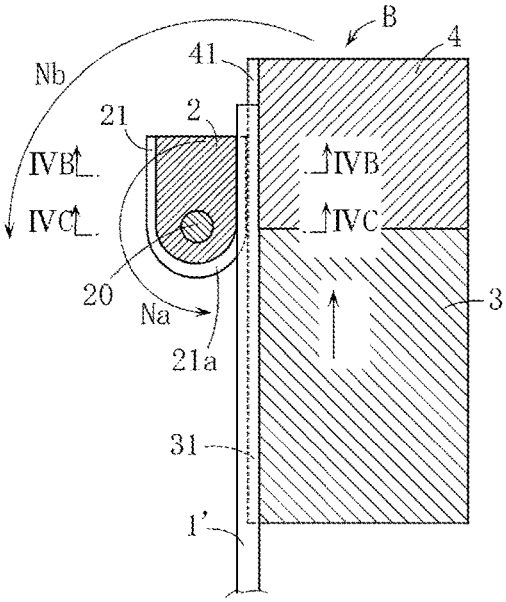
FIG. 4A is a plan cross-sectional view showing an example of the pipe bender used to manufacture the bend pipe shown in FIG. 1A.
Figure 4B:
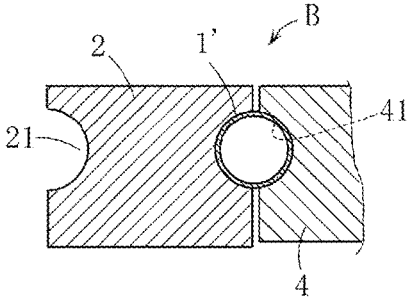
FIG. 4B is a cross-sectional view taken along line IVB-IVB in FIG. 4A.
Figure 4C:
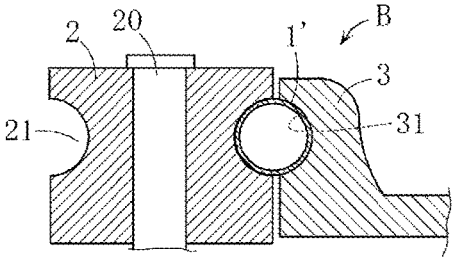
FIG. 4C is a cross-sectional view taken along line IVC-IVC of FIG. 4A.

In the series of processes, for example, a bending process of the metal pipe 1' is performed using a pipe bender B as shown in FIG. 4A to FIG. 4C. The pipe bender B includes: a roll block 2, a pressure mold 3, and a clamp mold 4. The roll block 2 is horizontally rotatable about a shaft part 20, and a first pipe-inserting recessed part 21 is formed in series on an outer circumferential surface thereof. The first pipe-inserting recessed part 21 has a bend portion 21*a* curved in an arc shape throughout an angle range of 180°. The pressure mold 3 is provided to press the metal pipe 1' against the roll block 2, and a second pipe-inserting recessed part 31 is formed in a side surface thereof. The clamp mold 4 is configured to clamp the metal pipe 1' between the clamp mold 4 and the roll block 2 and generate a pulling operation of the metal pipe V. A third pipe-inserting recessed part 41 is formed in a side surface of the clamp mold 4.

Figure 5:
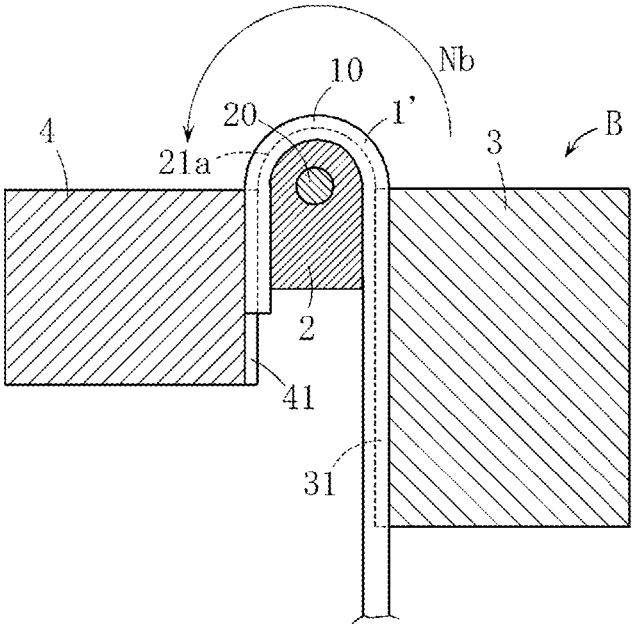
FIG. 5 is a planar cross-sectional view showing a state in which bending is performed using the pipe bender shown in FIG. 4A.

When a bending process is performed on the metal pipe 1', in a setting state as shown in FIG. 4A to FIG. 4C, the roll block 2 and the clamp mold 4 are horizontally rotated by 180° about the shaft part 20 as shown by arrows Na and Nb. As a result, as shown in FIG. 5, a part of the metal pipe 1' is bent while being disposed along the bend portion 21*a* of the roll block 2, and the bend portion 10 is formed. In such bending process, the metal pipe 1' is strongly pulled by the clamp mold 4, and a larger amount of tensile load is received by the bending-start side portion of the bend portion 10 than the bending-end side portion. For this reason, the metal pipe 1' has a smaller diameter and a smaller thickness at the bending-start side portion than the bending-end side portion.

Figure 6:
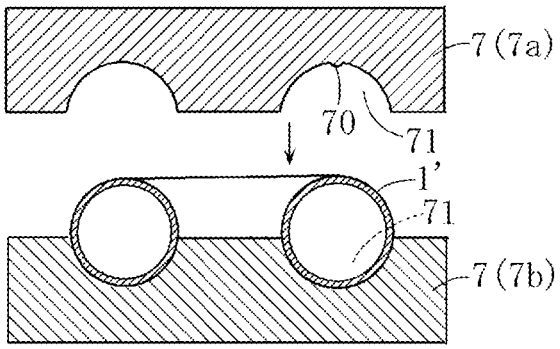
FIG. 6 is a cross-sectional view of a major part showing an example of a clamp member.

FIG. 6 shows a pair of clamp members 7 (7*a*, 7*b*) used to fix the metal pipe 1' in the cutting process of the metal pipe 1' shown in FIG. 3C. While the pair of clamp members 7*a* and 7*b* have recessed parts 71 into which the metal pipe 1' is fitted, the protruding part 70 is provided in the recessed part 71 of the one clamp member 7*a*. When the metal pipe 1' is clamped and fixed, since the protruding part 70 is pressed against the metal pipe 1', the identification part 5 is provided on an outer surface of the metal pipe 1' as the recessed part. As a result, the bend pipe 1 shown in FIG. 3D is manufactured.

Figure 7A:
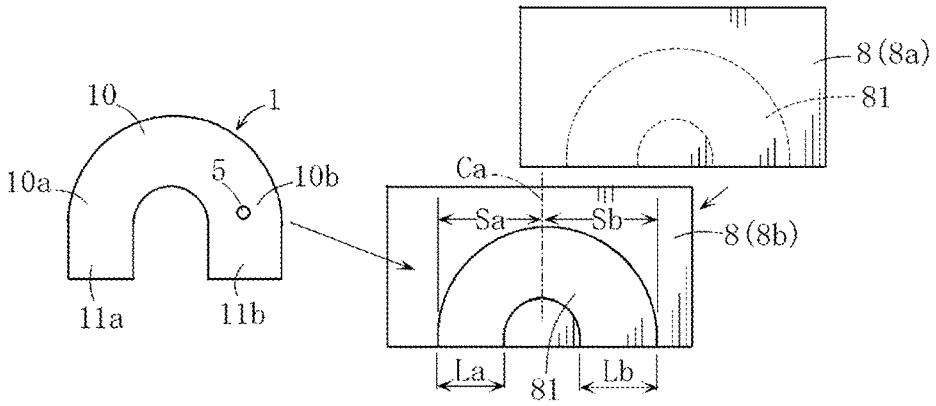
FIG. 7A is a schematic plan view of a major part showing another example of the clamp member.
Figure 7B:
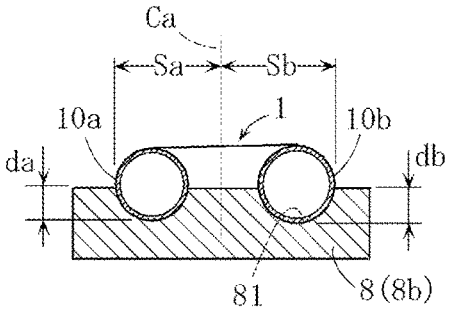
FIG. 7B is a cross-sectional view of a state in which the bend pipe is appropriately set in the clamp member shown in FIG. 7A.

FIG. 7A and FIG. 7B show a pair of upper and lower clamp members 8 (8*a*, 8*b*) used to fix the bend pipe 1 in a terminal treatment process shown in FIG. 3E. However, unlike the embodiment, it is also possible to continuously perform the terminal treatment process while holding the bend pipe 1 in the clamp member 7 used in the cutting process of FIG. 3C.

The clamp member 8 shown in FIG. 7A and FIG. 7B has a recessed part 81 with a semicircular arc shape into which the bend portion 10 of the bend pipe 1 is fitted. The recessed part 81 has a laterally asymmetrical shape, a first region Sa on the left side of a centerline Ca has a shape and a size corresponding to the vicinity of the end portion 10*a* of the bend portion 10 on the bending-start side, and a second region Sb on the right side of the centerline Ca opposite thereto has a shape and size corresponding to the vicinity of the end portion 10*b* of the bend portion 10 on the bending-end side. A width La and a depth da of an end portion of the first region Sa and a width Lb and a depth db of an end portion of the second region Sb have a relationship of La<Lb and da<db (in FIG. 7A, FIG. 7B, FIG. 8A and FIG. 8B, in order to make the understanding easier, the dimensional difference is shown in an exaggerated state).

Figure 8A:
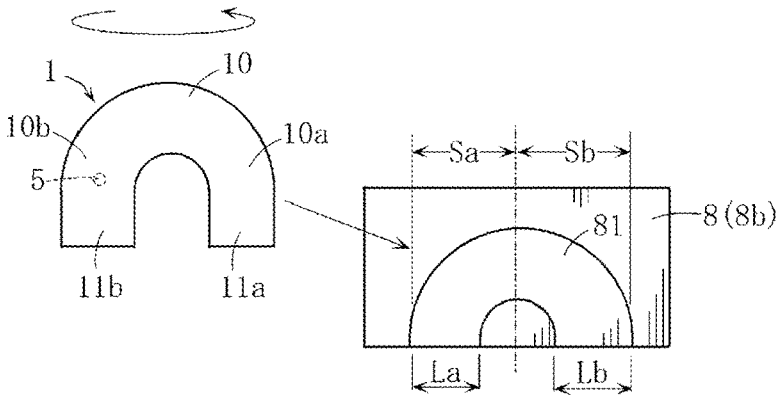
FIG. 8A is a schematic plan view of a major part showing a state in which the bend pipe is set to the clamp member shown in FIG. 7A in an opposite direction.
Figure 8B:
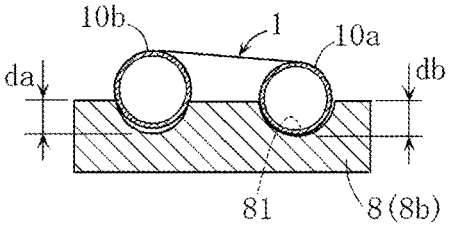
FIG. 8B is a cross-sectional view of a state in which setting of the bend pipe shown in FIG. 8A is performed.

According to the above-mentioned configuration, as shown in FIG. 7A and FIG. 7B, when the bend pipe 1 is fitted and set into the recessed part 81 of the clamp member 8*b*, in the case in which an orientation of the bend pipe 1 is correct, the end portion 10*a* of the bend pipe 1 on the bending-start side is disposed at the first region Sa and the end portion 10*b* on the bending-end side is disposed at the second region Sb, the bend pipe 1 can be appropriately set to the clamp member 8*b* with a small play. On the other hand, as shown in FIG. 8A and FIG. 8B, when the bend pipe 1 is oriented in a wrong direction that is opposite to the orientation shown in FIG. 7A and FIG. 7B, the bend portion 10 will not fit into the recessed part 81 in an appropriate coinciding state. This has an effect of making it easier for an operator to notice that the bend pipe 1 is in the wrong orientation.

When the bend pipe 1 is set to the clamp member 8*b*, it is desirable to set the bend pipe 1 to the correct orientation from the beginning without being incorrectly oriented as shown in FIG. 8A and FIG. 8B. On the other hand, when it is checked which side the identification part 5 provided on the bend pipe 1 is disposed (offset) with respect to the centerline CL of the bend portion 10, it is possible to easily and rapidly recognize which of both of the end portions 10*a* and 10*b* is the bending-end side of the bend portion 10. For this reason, according to the embodiment, it is possible to set the bend pipe 1 to the clamp member 8*b* in the correct orientation from the beginning.

In the clamp member configured to fix the bend pipe 1, it is possible to assume that the recessed part into which the entire bend portion 10 can be fitted is formed regardless of the orientation of the bend pipe 1 (for example, the clamp member 7 shown in FIG. 6 has such a configuration). However, when such a configuration is employed, it is necessary to take a relatively large amount of play allowance for the bend portion 10 in the recessed part. On the other hand, in the clamp member 8 shown in FIG. 7A, FIG. 7B, FIG. 8A and FIG. 8B, such a play allowance is considerably reduced, which is preferable for stably fixing the bend pipe 1.

In the terminal treatment process of FIG. 3E, outer diameters of the pair of pipe expanding punches 6*a* and 6*b* are different from each other. As described above, since the sizes of both of the end portions 10*a* and 10*b* of the bend portion 10 of the bend pipe 1 and the linear pipe parts 11*a* and 11*b* in the vicinity thereof are different from each other, even when the sizes of the punches 6*a* and 6*b* are equal to each other, diameters Da' and Db' of the terminal treatment parts 12*a* and 12*b* are not equal to each other. Provided that the sizes of the punches 6*a* and 6*b* are different from each other, it is possible to make the diameters Da' and Db' of the terminal treatment parts 12*a* and 12*b* be substantially the same.

The bend pipe 1A is used, for example, as a component of a heat transfer pipe of a heat exchanger, and is connected to an end portion of a linear pipe body section. In this case, for example, since brazing is performed, it is necessary to increase dimensional accuracy of the diameters Da' and Db' of the terminal treatment parts 12*a* and 12*b*. In particular, when the bend pipe 1A is formed of stainless steel, since brazing properties are not very good, it is desired to increase the dimensional accuracy for brazing. On the other hand, the bend pipe 1 of the embodiment can accurately conform to such demands.

As described above, in the embodiment, since the identification part 5 is provided on the bend pipe 1 (1A), when the terminal treatment parts 12*a* and 12*b* are provided, the processing can be appropriately performed. Of course, upon processing other than the terminal treatment or handling of the bend pipe 1 (1A), it is also convenient when distinguishing which side of the bend portion 10 is the bending-start side or the bending-end side is needed. In addition, since the identification part 5 is provided using the clamp member 7 upon clamping in the cutting process of the metal pipe 1', there is no need to separately perform special work to provide the identification part 5, and it is also possible to improve productivity. Further, since the identification part 5 is formed integrally with the bend pipe 1 as a three-dimensional region, for example, unlike seal sticking or printing, peeling or disappearance can be prevented during handling of the bend pipe 1.

FIG. 9 to FIG. 12 show another embodiment of the present invention. In these drawings, elements the same as or similar to those in the embodiment are designated by the same reference signs as the embodiment, and repeated description will be omitted.

Figure 9:
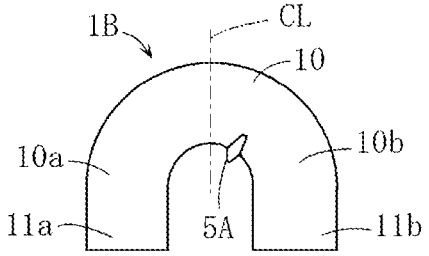
FIG. 9 is a front view showing another example of the bend pipe according to the present invention.

In the bend pipe 1B shown in FIG. 9, the identification part 5A serving as the wrinkle part is provided at a position in an inner circumferential surface of the bend portion 10 offset from the centerline CL in the widthwise direction toward the end portion 10*b* of the bend portion 10 on the bending-end side.

Figure 10A:
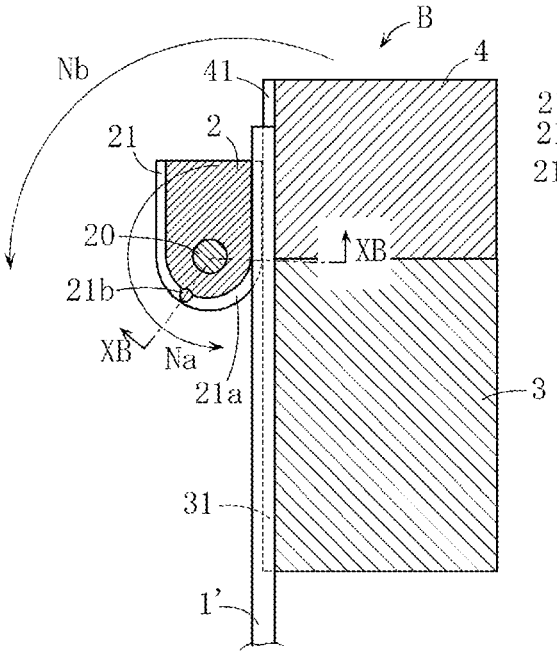
FIG. 10A is a plan cross-sectional view showing an example of the pipe bender used to manufacture the bend pipe shown in FIG. 9.
Figure 10B:
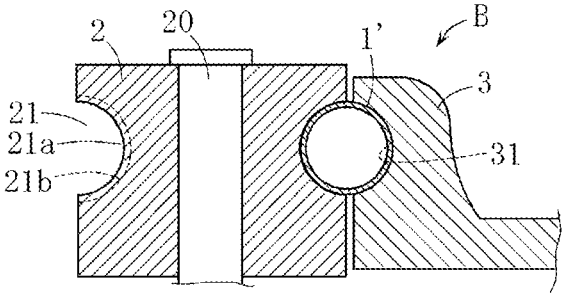
FIG. 10B is a cross-sectional view taken along line XB-XB of FIG. 10A.
Figure 11:
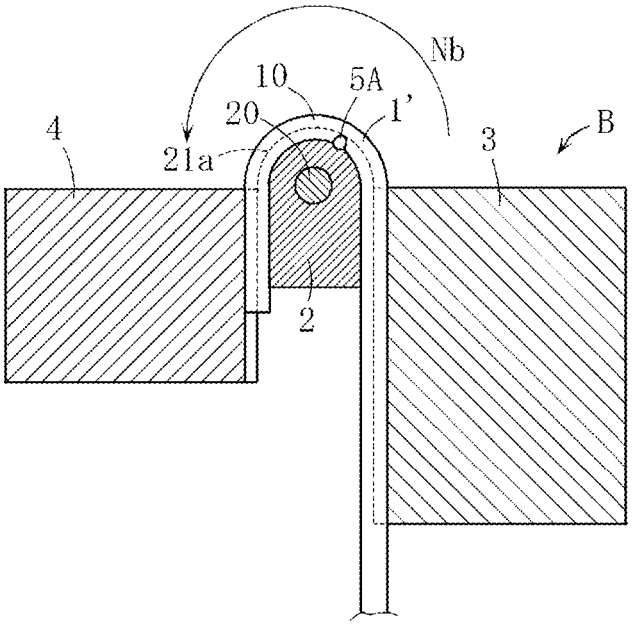
FIG. 11 is a plan cross-sectional view showing a state in which bending is performed using the pipe bender shown in FIG. 10A.

The above-mentioned bend pipe 1B can be manufactured through processes as shown in FIG. 10A, FIG. 10B and FIG. 11. That is, a recessed part 21*b* that is partially depressed is formed in the bend portion 21*a* of the roll block 2 of the pipe bender B shown in FIG. 10A and FIG. 10B. When bending is performed on the metal pipe 1' in the same process as has previously been described with reference to FIG. 4A, FIG. 4B and FIG. 5 using the pipe bender B having the above-mentioned configuration, the identification part 5A serving as the protruding wrinkle part corresponding to the recessed part 21*b* is formed in the inner circumferential surface of the bend portion 10. Also in the embodiment, like in the embodiment, it is not necessary to separately perform the process of providing the identification part 5A as a dedicated process.

In the bend pipe 1B shown in FIG. 9, like the bend pipes 1 and 1A described above, since the position of the identification part 5A is checked, it is possible to easily and accurately check which side of both of the end portions 10*a* and 10*b* of the bend portion 10 is the bending-start side or the bending-end side.

Figure 12:
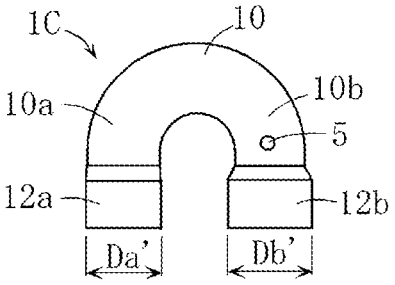
FIG. 12 is a front view showing another example of the bend pipe according to the present invention.

The bend pipe 1C shown in FIG. 12 is used to connect pipes having different diameters because the diameters Da' and Db' of the terminal treatment parts 12*a* and 12*b* are intentionally different. The present invention can also have such a configuration.

The present invention is not limited to the details of the above-mentioned embodiment. Various design changes in specific configurations of the respective parts of the bend pipe according to the present invention can be made without departing from the spirit of the present invention. Various changes in specific configurations of the respective processes of the method for manufacturing the bend pipe according to the present invention can also be made without departing from the spirit of the present invention.

In the above-mentioned embodiment, while the example in which the identification part is provided as the recessed part or the wrinkle part has been described, the present invention is not limited thereto. The identification part of the present invention may be formed integrally with the bend pipe as a protruding and/or recessed three-dimensional region such that which side of the two end portions of the bend portion is the bending-start side or the bending-end side can be identified. The identification part may be formed as a three-dimensional shape, a character, a sign, or the like. In addition, identification parts having different shapes or the like may be provided on both end portions of the bend pipe.

The identification part is preferably provided simultaneously during the cutting process, the bending process, or the like, of the metal pipe, but the present invention is not limited thereto and may be provided through a dedicated process. The identification part may be provided using means such as marking or the like.

In the bend pipe according to the present invention, it does not matter whether the terminal treatment is performed or not, the linear pipe part is connected to the bend portion, or the like. For example, both of the two bend pipes 1 and 1A shown in FIG. 1A to FIG. 1C, FIG. 2A and FIG. 2B are included within the technical scope of the present invention. While the bend pipe is suitable for use as a component of a heat transfer pipe of a heat exchanger, its specific use is not limited, and for example, it can be used as a general piping member. A material of the bend pipe is not limited to stainless steel.

The invention claimed is:

1. A method for manufacturing a bend pipe, comprising:

a bending process of pulling a metal pipe with a straight tubular shape formed of a starting material while bending the metal pipe along a circumferential surface of a roll block of a pipe bender, so as to form a bend portion with a semicircular arc shape in the metal pipe; and a cutting process of cutting the metal pipe after the bending process, wherein at any time from a beginning of the bending process to an end of the cutting process, an identification part providing process of integrally forming an identification part configured to identify which side of both end portions of the bend portion is a bending-start side or a bending-end side in the metal pipe as a protruding and/or recessed three-dimensional region is further provided, wherein the identification part is merely provided on one of the end portions of the bend portion, wherein in the cutting process, while the bend portion is clamped using a pair of clamp members, a protruding part for forming the identification part is provided on at least one of the pair of clamp members, and as the identification part providing process, a process of forming the recessed region as the identification part in an outer surface of the bend portion using the protruding part when the bend portion is clamped is provided.

2. A method for manufacturing a bend pipe, comprising:

a bending process of pulling a metal pipe with a straight tubular shape formed of a starting material while bending the metal pipe along a circumferential surface of a roll block of a pipe bender, so as to form a bend portion with a semicircular arc shape in the metal pipe; and a cutting process of cutting the metal pipe after the bending process, wherein at any time from a beginning of the bending process to an end of the cutting process, an identification part providing process of integrally forming an identification part configured to identify which side of both end portions of the bend portion is a bending-start side or a bending-end side in the metal pipe as a protruding and/or recessed three-dimensional region is further provided, wherein the identification part is merely provided on one of the end portions of the bend portion, wherein a process of fixing the bend portion using a pair of clamp members is provided, and each of the pair of clamp members has a recessed part with a semicircular arc shape into which the bend portion is fitted and set, the recessed part has a laterally asymmetrical shape, a first region of one side in a lateral width direction has a shape and a size corresponding to the bending-start side of the bend portion, and a second region opposite to the first region has a shape and a size corresponding to the bending-end side of the bend portion, and when an orientation of the bend portion in a case in which the bend portion is fitted into the recessed part is incorrect, the bend portion is not fitted into the recessed part in a coincided state.

* * * * *